US007528784B2

(12) United States Patent
Yamada et al.

(10) Patent No.: US 7,528,784 B2
(45) Date of Patent: May 5, 2009

(54) STRUCTURE FOR MOUNTING ANTENNA BASE ON VEHICLE BODY

(75) Inventors: Naofumi Yamada, Gunma (JP); Kazuki Katono, Gunma (JP); Hidehito Oki, Saitama (JP)

(73) Assignees: Yokowo Co., Ltd, Tokyo (JP); Honda Motor Co., Ltd., Tokyo (JP)

( * ) Notice: Subject to any disclaimer, the term of this patent is extended or adjusted under 35 U.S.C. 154(b) by 143 days.

(21) Appl. No.: 11/250,480

(22) Filed: Oct. 17, 2005

(65) Prior Publication Data

US 2006/0109186 A1 May 25, 2006

(30) Foreign Application Priority Data

Oct. 18, 2004 (JP) ..... P2004-302717

(51) Int. Cl.
*H01Q 1/32* (2006.01)

(52) U.S. Cl. ..... 343/713; 343/715

(58) Field of Classification Search ..... 343/713, 343/715, 878, 888

See application file for complete search history.

(56) References Cited

U.S. PATENT DOCUMENTS 6,762,727 B2 * 7/2004 Rochford et al. ..... 343/713

FOREIGN PATENT DOCUMENTS

JP A-8-237014 9/1996
JP A-8-335824 12/1996

* cited by examiner

*Primary Examiner*—Michael C Wimer
(74) *Attorney, Agent, or Firm*—Morgan, Lewis & Bockius LLP

(57) ABSTRACT

An antenna is adapted to be mounted on a vehicle body. An antenna base is formed with a first through hole. A first fixing screw is provided with a thread portion adapted to be inserted into a second through hole formed in the vehicle body via the first through hole, and a head portion continued from the thread portion and having a size larger than the second through hole. A receptacle is provided on the antenna base and receiving the head portion such that an axis of the first fixing screw is swingable relative to the vehicle body. A nut is adapted to be fitted with the thread portion so as to clamp the vehicle body together with the head portion.

18 Claims, 12 Drawing Sheets

STRUCTURE FOR MOUNTING ANTENNA BASE ON VEHICLE BODY

BACKGROUND OF THE INVENTION

The present invention relates to a structure suitable for mounting an antenna base to a vehicle body having a curved surface.

As shown in Japanese Patent Publication Nos. 8-335824A and 8-237014A, in a conventional attaching structure for mounting an antenna to a vehicle body, a single fixing screw is arranged so as to protrude downward from an antenna base. Then, the fixing screw is inserted into a hole drilled in a vehicle body, while a nut is engaged from the back side. Thus, the vehicle body is clamped between the antenna base and the nut, so that the antenna base is fixed to the vehicle body.

The above-mentioned conventional structure does not have a specific problem as long as the size of the antenna base is not very large and a single fixing screw suffices for fixing the antenna base reliably. However, popularization of car-installed communication equipments with composite construction in recent years leads to, in turn, necessity of the suitable antenna with composite construction, and hence increase of the size of the antenna base for mounting the antenna to the vehicle body is unavoidable. In this case, fixing the antenna base with a single fixing screw may be unstable in view of mechanical intensity. Thus, plural fixing screws are necessary for reliably fixing the antenna base to the vehicle body.

FIG. 13 shows such a structure in which two fixing screws 16 are integrally arranged so as to protrude downward in an antenna base 12 having a relatively large size. In this structure, the two fixing screws 16 integrally provided with the antenna base 12 are inserted into holes 22 drilled in a vehicle body 20, while nuts 32 are engaged with the fixing screws 16 respectively from the back side. Further, a pad 26 having elasticity is inserted between the antenna base 12 and the vehicle body 20. Thus, when the nuts 32 are tightened, the antenna base 12 is reliably fixed to the vehicle body 20, while the pad 26 prevents rain water from entering into the vehicle body through the holes 22. Here, in FIG. 13, numeral 10 indicates an antenna case in a bottom face part of which the antenna base 12 is arranged appropriately. Numeral 14 indicates a rod-shaped antenna element a pedestal end of which is fixed to the antenna case 10. Numeral 28 indicates a washer inserted between the vehicle body 20 and the nut 32.

In recent years, the vehicle body 20 is formed with a combination of complicated curved surfaces for the purpose of good appearance. Thus, there will be no problem, if the bottom surface of the antenna base 12 had a shape corresponding to the curved surface of the attached portion of the vehicle body 20. However, when the bottom surface of the antenna base 12 would not agree with the shape of the vehicle body 20, the tightening of the nuts 32 could generate deformation in the vehicle body 20 so as to follow the shape of the bottom surface of the antenna base 12.

Here, it should be noted that even in the conventional structure where a single fixing screw is arranged and protruded and where the bottom surface of the antenna base is a curved surface in agreement with the curved surface of the vehicle body, the tightening of the nut could similarly generate deformation in the vehicle body if the antenna base would deviate from an appropriate attached portion, so that the bottom surface of the antenna base would not agree with the curved surface of the vehicle body.

SUMMARY OF THE INVENTION

It is therefore object of the invention to provide a structure that allows an antenna base to be mounted on a vehicle body without generating the above-mentioned deformation in the vehicle body.

In order to achieve the above object, according to the invention, there is provided an antenna adapted to be mounted on a vehicle body, comprising:

an antenna base, formed with a first through hole;

a first fixing screw, comprising a first thread portion adapted to be inserted into a second through hole formed in the vehicle body via the first through hole, and a first head portion continued from the first thread portion and having a size larger than the second through hole;

a receptacle, provided on the antenna base and receiving the first head portion such that an axis of the first fixing screw is swingable relative to the vehicle body; and a first nut, adapted to be fitted with the first thread portion so as to clamp the vehicle body together with the first head portion.

With this configuration, the first fixing screw swings in accordance with the curved surface of the vehicle body, and thereby reduces deformation in the vehicle body in comparison with a conventional example where a fixed fixing screw is solely used.

The antenna may further comprise:

a second fixing screw integrally provided on the antenna base, the second fixing screw comprising a second thread portion adapted to be inserted into a third through hole formed in the vehicle body, and a second head portion continued from the second thread portion and having a size larger than the third through hole; and a second nut, adapted to be fitted with the second thread portion so as to clamp the vehicle body together with the second head portion.

In this case, the first fixing screw is swingable under a condition that the antenna base is provisionally fixed on the vehicle body by the second fixing screw and the second nut.

The antenna may further comprise an elastic pad disposed between the antenna base and the vehicle body.

In this case, the pad can absorb variation in the gap dimension between the antenna base and the vehicle body.

A size of the first through hole may be smaller than the size of the first head portion so that the receptacle has a receiving face brought into contact with a lower face of the first head portion.

In this case, the fixing screw can be prevented from escaping toward the vehicle body with a simple structure.

Here, at least one of the receiving face and the lower face of the first head portion may be rounded.

In this case, the swing movement of the first fixing screw can be smoothened.

The antenna may further comprise an elastic spacer disposed between the receptacle and the first head portion.

In this case, the gap between the first head portion and the receptacle can be reduced. This allows the antenna base to be fixed stably to a vehicle body.

A direction that the first fixing screw is swingable may be so restricted as to be a longitudinal direction of the antenna base.

Here, the first head portion may be provided with a shaft member extending in a direction perpendicular to the longitudinal direction of the antenna base, and the receptacle may be formed with a groove receiving the shaft member.

Alternatively, a protrusion may be formed on the antenna base so as to extend in a direction perpendicular to the longitudinal direction of the antenna base, and the first head portion may be formed with a groove receiving the protrusion.

In this case, the deformation in the vehicle body which tends to be large in the longitudinal direction of the antenna base can be effectively reduced.

The antenna may further comprise a retainer provided on the antenna base so as to hang over the first head portion to prevent the first fixing screw from escaping in a direction being away from the vehicle body.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

A first embodiment of the invention will be described below in detail with reference to FIGS. 1 through 5B.

Figure 1:
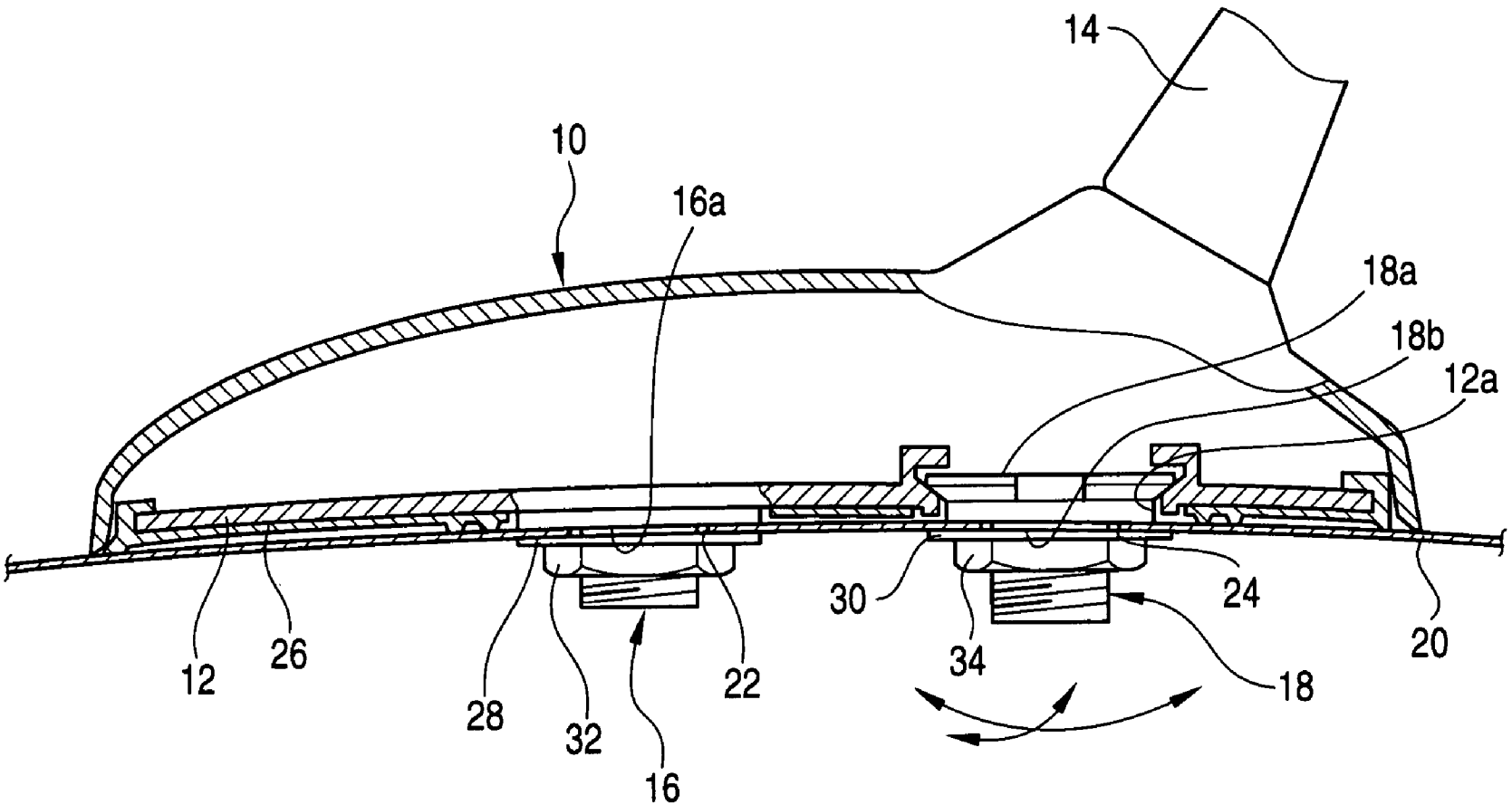
FIG. 1 is a side section view of a structure for mounting an antenna base on a vehicle body, according to a first embodiment of the invention.

In FIG. 1, a metallic antenna base 12 is arranged appropriately in a bottom face part of an antenna case 10. A pedestal end of a rod-shaped antenna element 14 is fixed to the antenna case 10. The antenna case 10 accommodates a GPS antenna and other planar antennas as well as appropriate electrical circuits, which are not shown. Two fixing screws 16 and 18 are arranged so as to protrude downwardly at front and rear positions, respectively, on a straight line in the longitudinal direction of the antenna base 12 (corresponding to the front-rear direction of the vehicle). Then, one fixing screw 16 arranged on the front side is fixed to the antenna base 12, while the other fixing screw 18 arranged on the rear side is arranged in a manner freely swingable by a small angle relative to the antenna base 12 by a structure described later.

In a vehicle body 20 to which the antenna base 12 is attached, two holes 22 and 24 are drilled in correspondence to the two fixing screws 16 and 18. Then, in such a manner that a pad 26 having elasticity is arranged on the bottom surface of the antenna base 12, the two fixing screws 16 and 18 are inserted into the holes 22 and 24, respectively. Nuts 32 and 34 are then engaged via washers 28 and 30 from the inner side of the vehicle body, so that the antenna base 12 is fixed to the vehicle body 20.

Figure 2A:
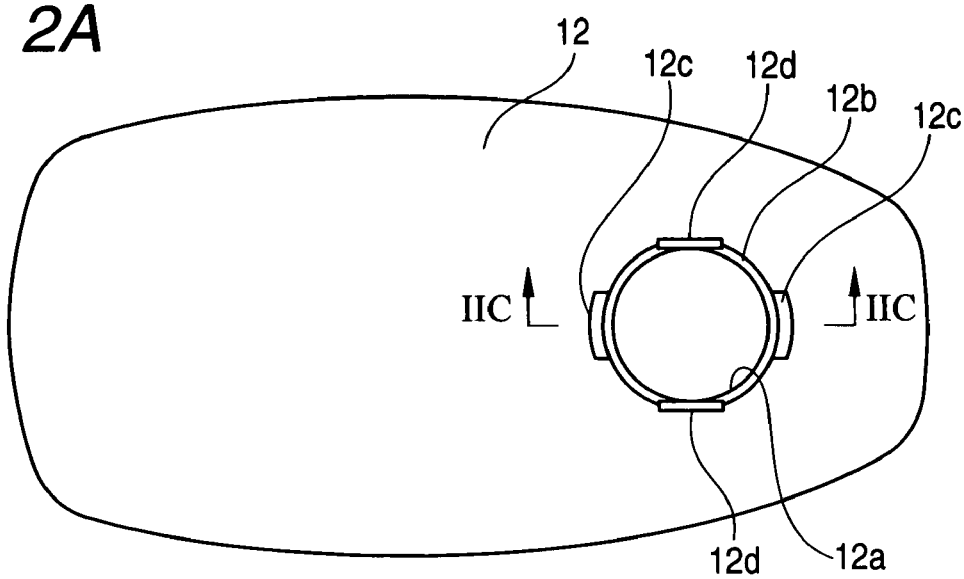
FIG. 2A is a top view of the antenna base of FIG. 1.
Figure 2B:
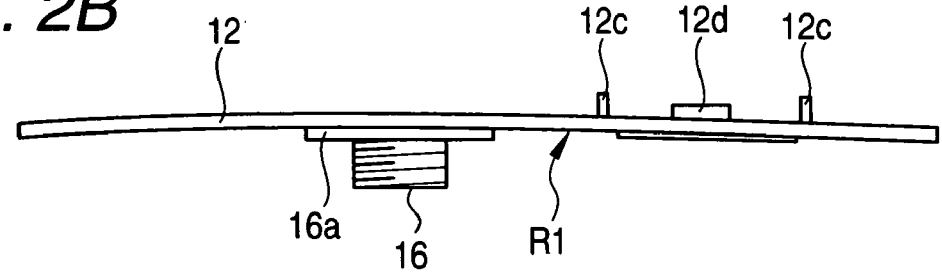
FIG. 2B is a side view of the antenna base of FIG. 2A.
Figure 2C:
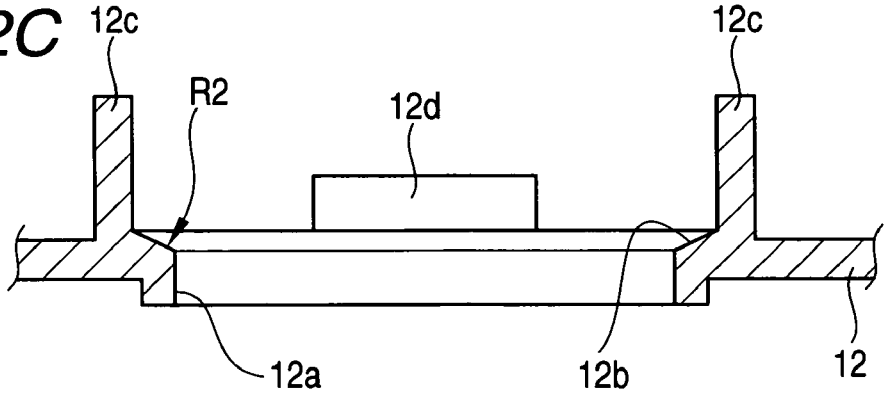
FIG. 2C is a section view taken along a line IIC-IIC in FIG. 2A.

As shown in FIGS. 2A to 2C, the bottom surface of the antenna base 12 is formed in a curved surface having an appropriate curvature radius R1 in accordance with the curved surface of the installation part of the vehicle body 20. Further, a step portion 16*a* is formed in the fixing screw 16 to be fixed to the antenna base 12. Further, in the antenna base 12, a hole 12*a* is drilled into which the fixing screw 18 arranged swingably is inserted. An upper face edge 12*b* of this hole 12*a* is tapered so as to have an appropriate curvature radius R2. Then, a pair of caulking protrusions 12*c* are provided in upper face periphery of the hole 12*a*. Further, a pair of protrusions 12*d* are so provided as to prevent the fixing screw 18 from rotating about the screw axis.

Figure 3A:
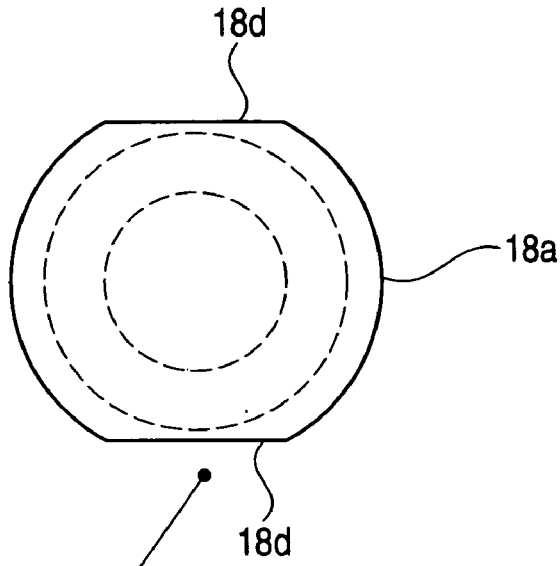
FIG. 3A is a top view of a swingable fixing screw in the mounting structure of FIG. 1.
Figure 3B:
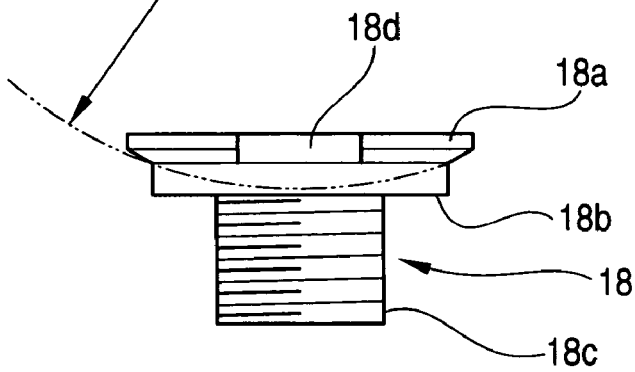
FIG. 3B is a side view of the swingable fixing screw of FIG. 3A.
Figure 3C:
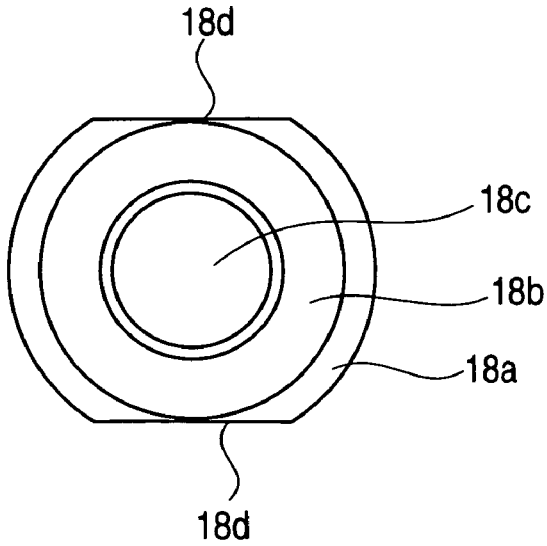
FIG. 3C is a bottom view of the swingable fixing screw of FIG. 3A.

As shown in FIGS. 3A to 3C, in the fixing screw 18 to be arranged swingably, a bulge 18*a* is provided at an end. Further, a step portion 18*b* is formed, while a male screw 18*c* is engraved at the other end which is to be inserted into the hole 12*a*. Then, a bottom surface of the bulge 18*a* is so curved as to have a curvature radius R2. Further, in the bulge 18*a*, cutouts 18*d* are provided to restrict the rotation of the screw 18. The shape in top view of the bulge 18*a* is slightly smaller than but in approximate similarity to the shape in top view of the upper face edge 12*b* of the hole 12*a* of the antenna base 12.

Figure 4:
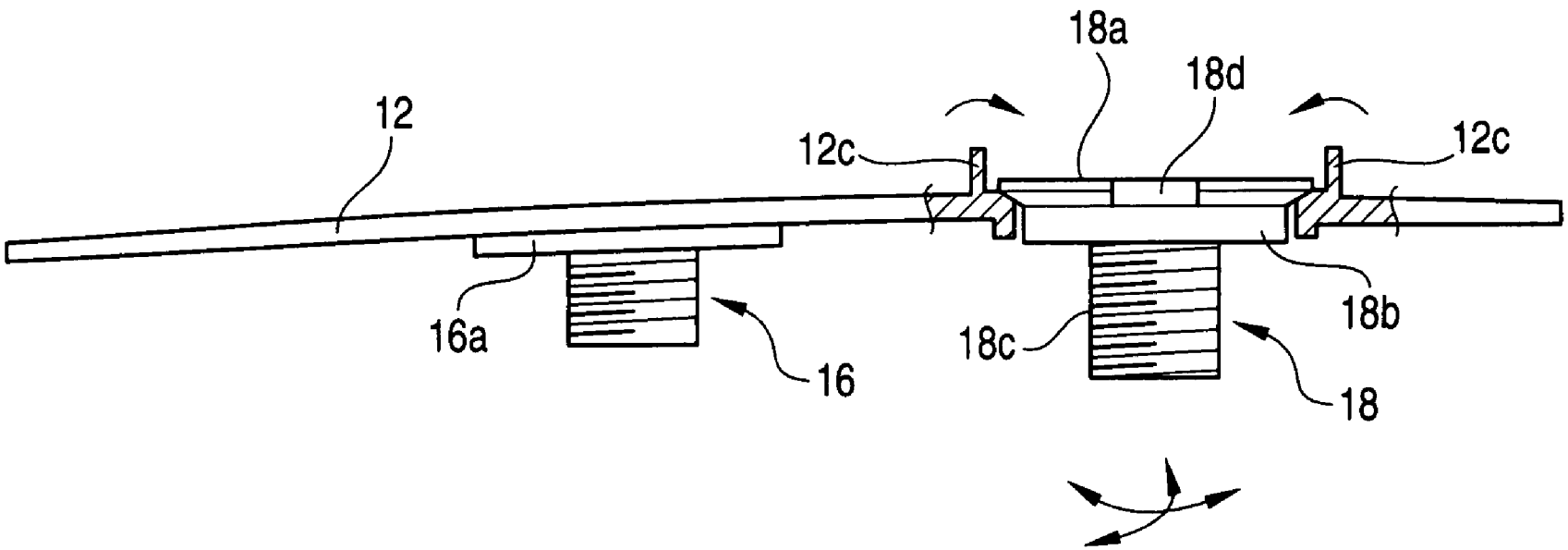
FIG. 4 is a side view for explaining how to retain the swingable fixing screw in the antenna base.

Further, as shown in FIG. 4, the male screw 18*c* of the fixing screw 18 is inserted into the hole 12*a* of the antenna base 12 from the above. Then, downward escape of the screw 18 is restricted by the bulge 18*a*. In this arrangement, the shape of the upper face edge 12*b* of the hole 12*a* of the antenna base 12 agrees with the shape of the bulge 18*a* of the fixing screw 18, so that the fixing screw 18 does not rotate relative to the hole 12*a* about the screw axis. Here, the shape of the upper face edge 12*b* of the hole 12*a* and the shape of the bulge 18*a* have dimensions so as to restrict solely the relative rotation of the fixing screw 18 about the screw axis and not to restrict the swing of the screw axis of the fixing screw 18 relative to the hole 12*a* in an appropriate range. Further, the protrusions 12*c* of the antenna base 12 are bent (as indicated by arrows) so as to hang over the bulge 18*a* of the fixing screw 18 as shown in FIG. 1, so that the fixing screw 18 should not escape upward from the hole 12*a*. The bending of the protrusions 12*c* is set up to such an extent that it restricts solely the upward escape of the fixing screw 18, and does not restrict the swing of the fixing screw 18 in the screw axis direction.

In this embodiment, both of the bottom surface of the bulge 18*a* of the fixing screw 18 and the upper face edge 12*b* of the hole 12*a* of the antenna base 12 are rounded. However, as far as at least one of these surfaces is rounded, smooth swing is achieved in the fixing screw 18.

Figure 5A:
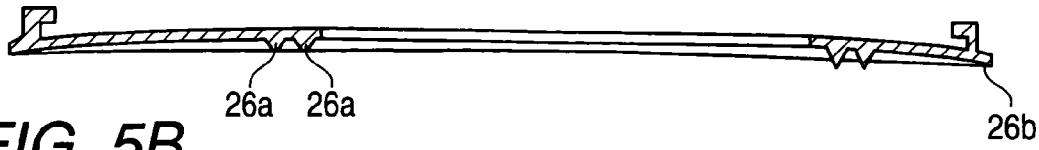
FIG. 5A is a side section view of a pad in the mounting structure of FIG. 1.
Figure 5B:
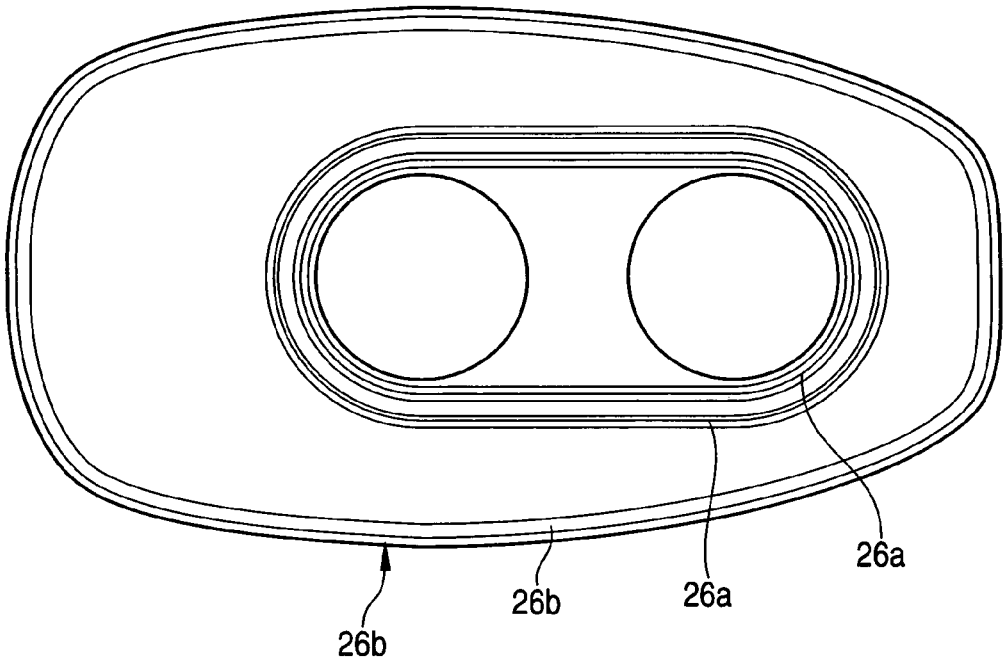
FIG. 5B is a bottom view of the pad of FIG. 5A.

Further, in the pad 26 inserted between the antenna base 12 and the vehicle body 20, ridges 26*a* are provided in the bottom surface so as to surround the two fixing screws 16 and 18 as shown in FIGS. 5A and 5B. Further, a rim 26*b* is provided in the periphery edge of the pad 26. The pad 26 is composed of elastic material such as rubber. When attached to the antenna base 12 as shown in FIG. 1, the pad 26 is compressed between the antenna base 12 and the vehicle body 20, so that the ridges 26*a* and the rim 26*b* respectively deform elastically and thereby contact closely to the vehicle body 20.

In this configuration, the fixing screws 16 and 18 are inserted respectively into the holes 22 and 24 of the vehicle body 20, so that the antenna case 10 is installed in the vehicle body 20. Then, first, the nut 32 is engaged and tightened on the one fixing screw 16 to be fixed to the antenna base 12, so that the vehicle body 20 is clamped between the step portion 16*a* and the washer 28. After that, the nut 34 is engaged and tightened on the other fixing screw 18 to be arranged swingably relative to the antenna base 12, so that the vehicle body 20 is clamped between the step portion 18*b* and the washer 30. Then, the compressed pad 26 elastically biases the antenna base 12 upward, and thereby causes the upper face edge 12*b* of the hole 12*a* of the antenna base 12 to contact with the bottom surface of the bulge 18*a* of the fixing screw 18. As a result, the antenna base 12 is fixed stably to the fixing screw 18. Here, in the engaging of the nut 34, rotation of the fixing screw 18 about the screw axis is restricted by the structure formed by the bulge 18*a* of the fixing screw 18 and the upper face edge 12*b* of the hole 12*a*. Thus, the antenna base 12 is fixed to the vehicle body 20, and the antenna case 10 is fixed to the vehicle body 20.

In the fixing of the antenna case 10 to the vehicle body 20, even when the curved surface of the vehicle body 20 deviates from the curved surface of the bottom face of the antenna base 12, the swingable fixing screw 18 swings appropriately relative to the vehicle body 20 so that the screw axis direction is adjusted and fixed in a perpendicular orientation. Here, since the rounded bottom surface of the bulge 18*a* is brought into contact with the rounded upper face edge 12*b* of the hole 12*a* having the same curvature radius, the swing of the fixing screw 18 is achieved very smoothly. This remarkably reduces deformation in the vehicle body 20. Further, the pad 26 absorbs variation in the gap between the vehicle body 20 and the antenna base 12, and further prevents rain water from entering into the vehicle body 20 through the holes 22 and 24.

In this embodiment, the fixed fixing screw 16 is arranged on the front side of the antenna base 12, while the swingable fixing screw 18 is arranged on the rear side, However, the freely swingable fixing screw 18 may be arranged on the front side of the antenna base 12, and the fixed fixing screw 16 may be arranged on the rear side. Further, while a pair of protrusions 12*c* are provided on the upper face of the antenna base 12 in this embodiment, merely a single protrusion 12*c* may be arranged, or alternatively, two or more protrusions may be provided, as long as the upward escape of the fixing screw 18 is prevented.

Figure 6:
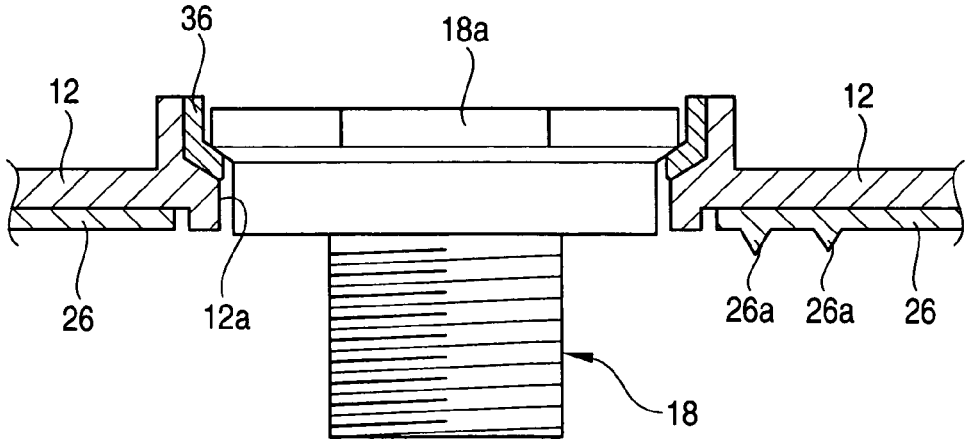
FIG. 6 is an enlarged side section view of a swingable fixing screw in a mounting structure according to a second embodiment of the invention.

Next, a second embodiment of the invention will be described below with reference to FIG. 6. Similar components to those in the first embodiment will be designated by the same reference numerals, and repetitive explanations for those will be omitted.

In this embodiment, a spacer 36 composed of elastic material such as rubber is inserted between the bottom surface of the bulge 18*a* of the fixing screw 18 and the upper face edge 12*b* of the hole 12*a* of the antenna base 12. The spacer 36 is so compressed therebetween, so that the antenna base 12 downward is elastically urged downwardly. This eliminates a gap between the antenna base 12 and the bottom surface of the bulge 18*a* of the fixing screw 18, and thereby allows the antenna base 12 to be fixed more reliably to the fixing screw 18. Thus, the antenna base 12 is fixed stably to the vehicle body 20.

Here, the bottom surface of the bulge 18*a* of the fixing screw 18 and the upper face edge 12*b* of the hole 12*a* of the antenna base 12 need not necessarily be rounded. That is, variation in the gap between the bottom surface of the bulge 18*a* and the upper face edge 12*b* of the hole 12*a* is absorbed by the spacer 36, and thereby does not hinder the smooth swing of the fixing screw 18.

Figure 7:
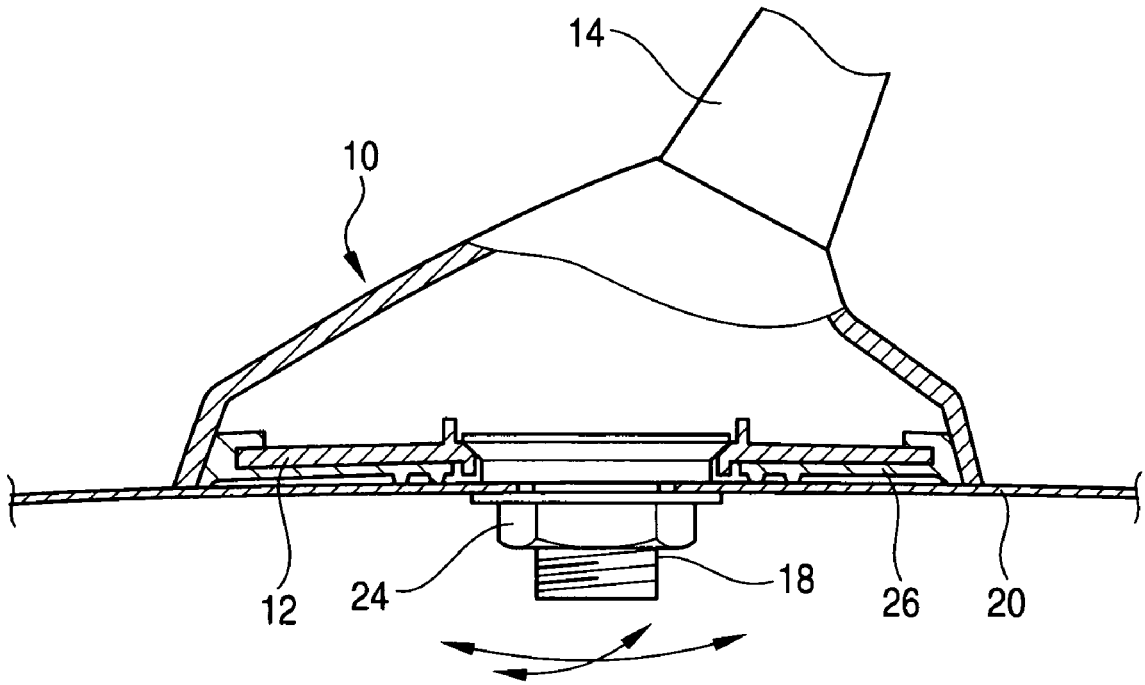
FIG. 7 is a side section view of a mounting structure according to a third embodiment of the invention.

Next, a third embodiment of the invention will be described below with reference to FIG. 7. Similar components to those in the first embodiment will be designated by the same reference numerals, and repetitive explanations for those will be omitted.

In this embodiment, a single fixing screw 18 is solely arranged that can swing relative to the antenna base 12. The fixing screw 18 is fixed in an orientation perpendicular to the vehicle body 20. Thus, even when the curved surface of the bottom face of the antenna base 12 deviates slightly from the curved surface of the vehicle body 20, deformation is not generated in the vehicle body 20.

Figure 8:
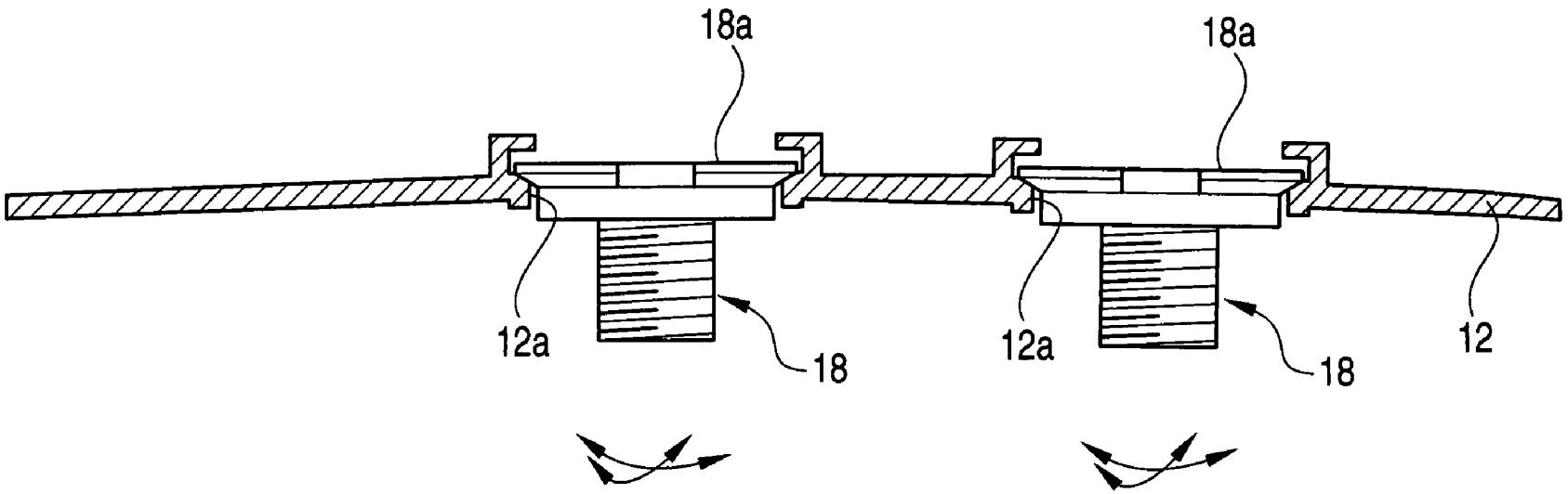
FIG. 8 is a side section view of a mounting structure according to a fourth embodiment of the invention.

Next, a fourth embodiment of the invention will be described below with reference to FIG. 8. Similar components to those in the first embodiment will be designated by the same reference numerals, and repetitive explanations for those will be omitted.

In this embodiment, two fixing screws 18 which are swingable relative to the antenna base 12 are arranged at front and rear positions on a straight line in the longitudinal direction of the antenna base 12. Accordingly, each of the two fixing screws 18 is fixed in an orientation perpendicular to the vehicle body 20. This further reduces deformation in the vehicle body 20.

Figure 9A:
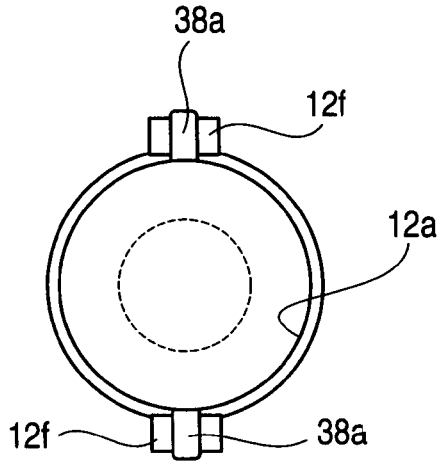
FIG. 9A is a top view of a swingable fixing screw in a mounting structure according to a fifth embodiment of the invention.
Figure 9B:
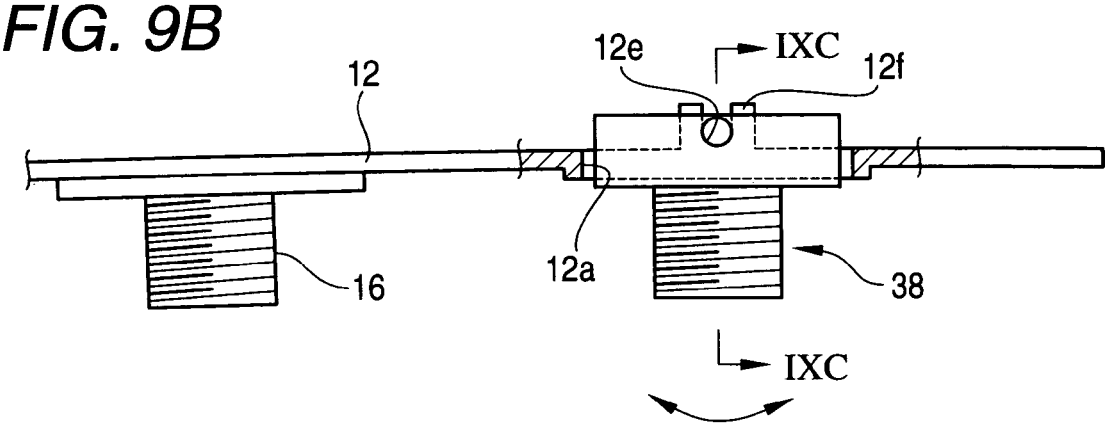
FIG. 9B is a partially sectional side view of the mounting structure of FIG. 9A.
Figure 9C:
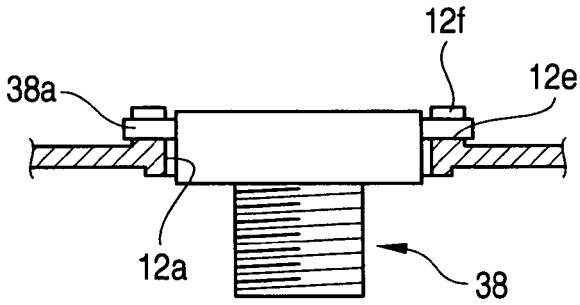
FIG. 9C is a section view taken along a line IXC-IXC in FIG. 9B.

Next, a fifth embodiment of the invention will be described below with reference to FIGS. 9A to 9C. Similar components to those in the first embodiment will be designated by the same reference numerals, and repetitive explanations for those will be omitted.

In the first through the fourth embodiments described above, the direction of the swing of the swingable fixing screw 18 relative to the antenna base 12 is not restricted at all. In this embodiment, the swingable direction is restricted. Specifically, at an upper end of an fixing screw 38, a pair of swing shafts 38*a* are provided so that they protrude toward both sides of a direction perpendicular to the screw axis. Corresponding to these shafts 38*a*, in the periphery of the hole 12*a* on the upper face of the antenna base 12, bearings 12*f* formed with U-shaped grooves 12*e* into which the swing shafts 38*a* are inserted from above are protruded on both sides in a direction parallel to the screw axis. The fixing screw 38 is inserted into the hole 12*a* of the antenna base 12, while the swing shafts 38*a* are inserted into the U-shaped grooves 12*e* of the bearings 12*f*. This prevents the fixing screw 38 from escaping downwardly, and still allows the screw to swing about the swing shafts 38*a* serving as a pivot center. Here, the fixing screw 38 is arranged in a manner swingable within a plane that is approximately perpendicular to the antenna base 12 and that includes a straight line connecting the positions of the fixing screw 16 fixed to the antenna base 12 and the swingable fixing screw 18. In this embodiment, a bulge is formed at the upper end of the fixing screw 38. However, the bulge need not necessarily be formed.

This configuration simplifies the arrangement that allows the fixing screw 38 to swing relative to the antenna base 12. Further, the two fixing screws 16 and 38 are arranged in the longitudinal direction of the antenna base 12, and the fixing screw 38 can swing in the direction approximately perpendicular to a plane including the longitudinal direction. While the shape of the curved surface of the vehicle body 20 of the longitudinal direction can easily deviate from the curved surface of the bottom face of the antenna base 12, the deformation of the vehicle body 20 due to the deviation of the curved surface can be effectively prevented by the configuration of this embodiment.

Figure 10A:
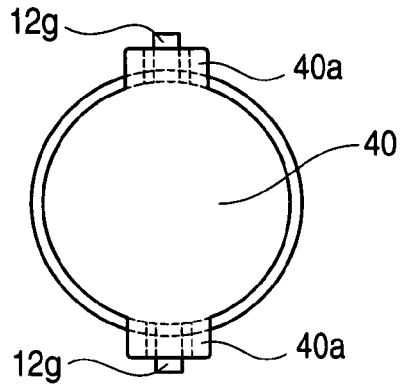
FIG. 10A is a top view of a swingable fixing screw in a mounting structure according to a sixth embodiment of the invention.
Figure 10B:
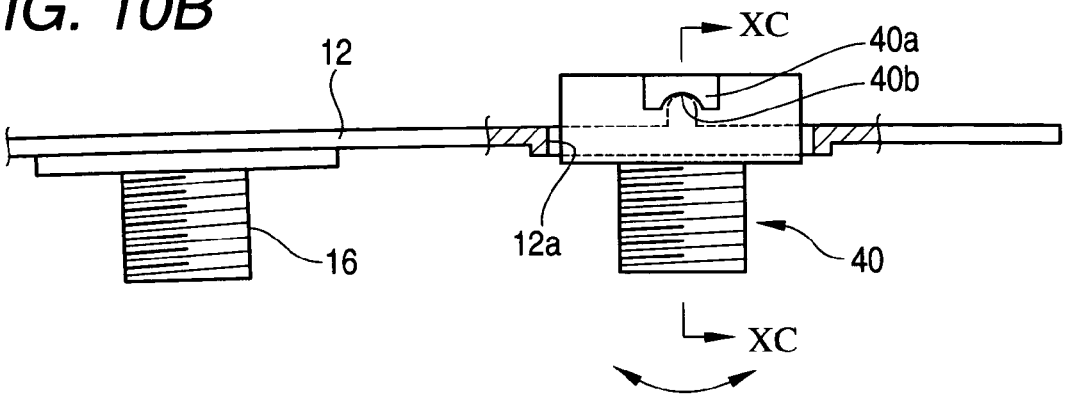
FIG. 10B is a partially sectional side view of the mounting structure of FIG. 10A.
Figure 10C:
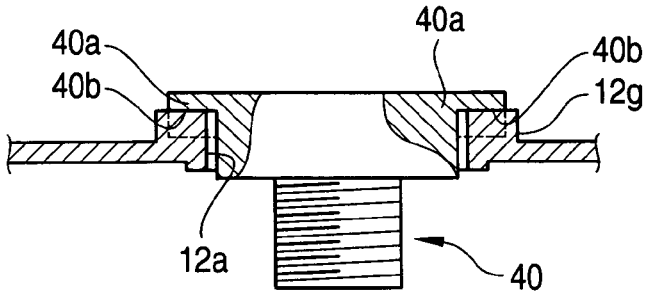
FIG. 10C is a section view taken along a line XC-XC in FIG. 10B.

Next, a sixth embodiment of the invention will be described below with reference to FIGS. 10A to 10C. Similar components to those in the first embodiment will be designated by the same reference numerals, and repetitive explanations for those will be omitted.

In this embodiment, at an upper end of an fixing screw 40, a pair of bearings 40*a* are provided so that they protrude on both sides in a direction perpendicular to the screw axis. In the bearings 40*a*, U-shaped grooves 40*b* are formed respectively from below. Then, on the upper face of the antenna base 12, there is provided a pair of protrusions 12*g*, each upper end of which is formed in a semicircular shape in vertical cross section. Then, the fixing screw 40 is inserted into the hole 12*a* of the antenna base 12, and the protrusions 12*g* are respectively inserted into the U-shaped grooves 40*b* of the bearings 40*a*. This prevents the fixing screw 40 from escaping downwardly, and still allows the screw to swing about the upper ends of the protrusions 12*g* serving as a pivot center. Obviously, the configuration is such that the upper ends of the protrusions 12*g* should contact the bottoms of the U-shaped grooves 40*b*. Advantage similar to that in the fifth embodiment can be obtained.

Here, in the fifth and the sixth embodiments, the fixed fixing screw 16 and the swingable fixing screw 38 or 40 are arranged in the antenna base 12. However, in place of the fixed fixing screw 16, the swingable fixing screw 18 of the first embodiment may be arranged. Alternatively, the swingable fixing screw 38 or 40 of the fifth or the sixth embodiment may be arranged. Further, a swing shaft may be arranged through a pair of arms protruding from the upper face of the antenna base 12, and the swing shaft may penetrate through the upper end portion of the fixing screw so that the fixing screw is swingable about the swing shaft.

Figure 11A:
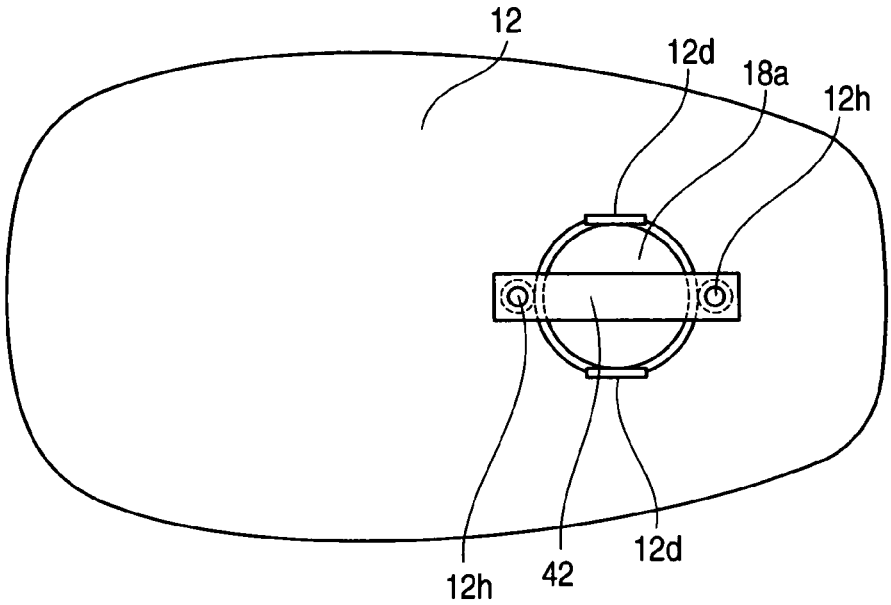
FIG. 11A is a top view of a mounting structure according to a seventh embodiment of the invention.
Figure 11B:
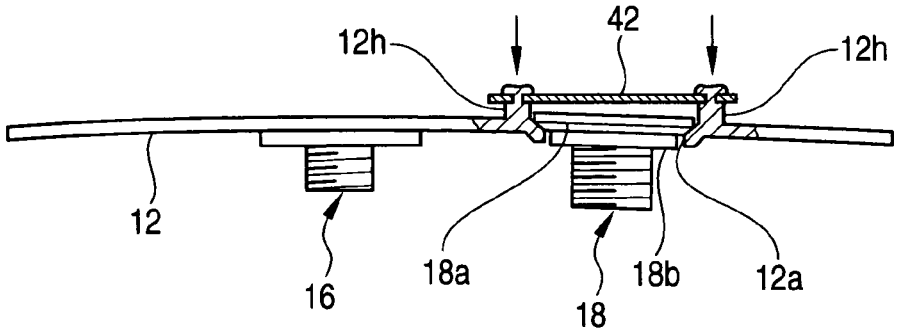
FIG. 11B is a partially sectional side view of the mounting structure of FIG. 11A.

Next, a seventh embodiment of the invention will be described below with reference to FIGS. 11A and 11B. Similar components to those in the first embodiment will be designated by the same reference numerals, and repetitive explanations for those will be omitted.

In the first embodiment, the protrusions 12*c* are provided on the upper face of the antenna base 12 and adapted to be bent so as to prevent the fixing screw 18 from escaping upward. In the present embodiment, a pair of bosses 12*h* are provided on the upper face of the antenna base 12, while a retainer 42 composed of resin or metal is fixed to the bosses 12*h* by caulking or the like (as indicated by arrows). The retainer 42 fixed to the bosses 12*h* is obviously arranged so as to hang over the bulge 18*a* of the fixing screw 18.

With the above configuration, the structure for preventing the fixing screw 18 from escaping upward can be simplified in comparison with the work of bending the protrusions 12*c* in the first embodiment.

Figure 12A:
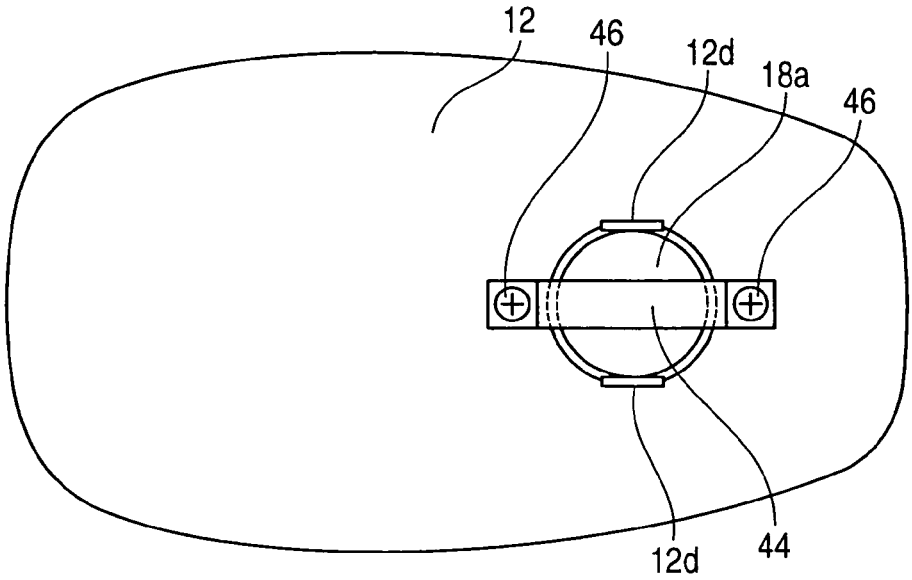
FIG. 12A is a top view of a mounting structure according to an eighth embodiment of the invention.
Figure 12B:
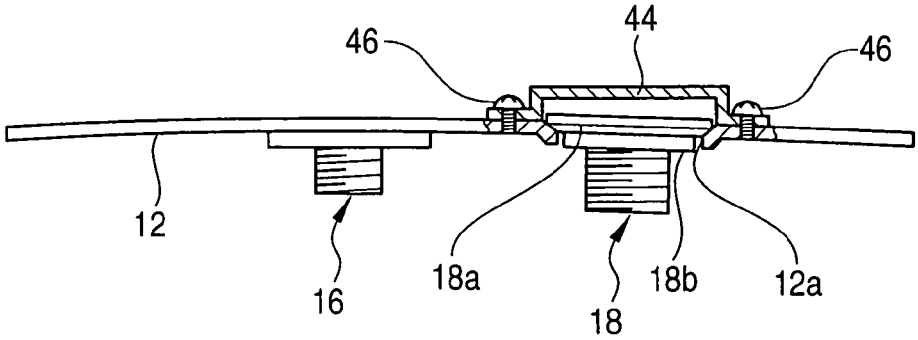
FIG. 12B is a partially sectional side view of the mounting structure of FIG. 12A.
Figure 13:
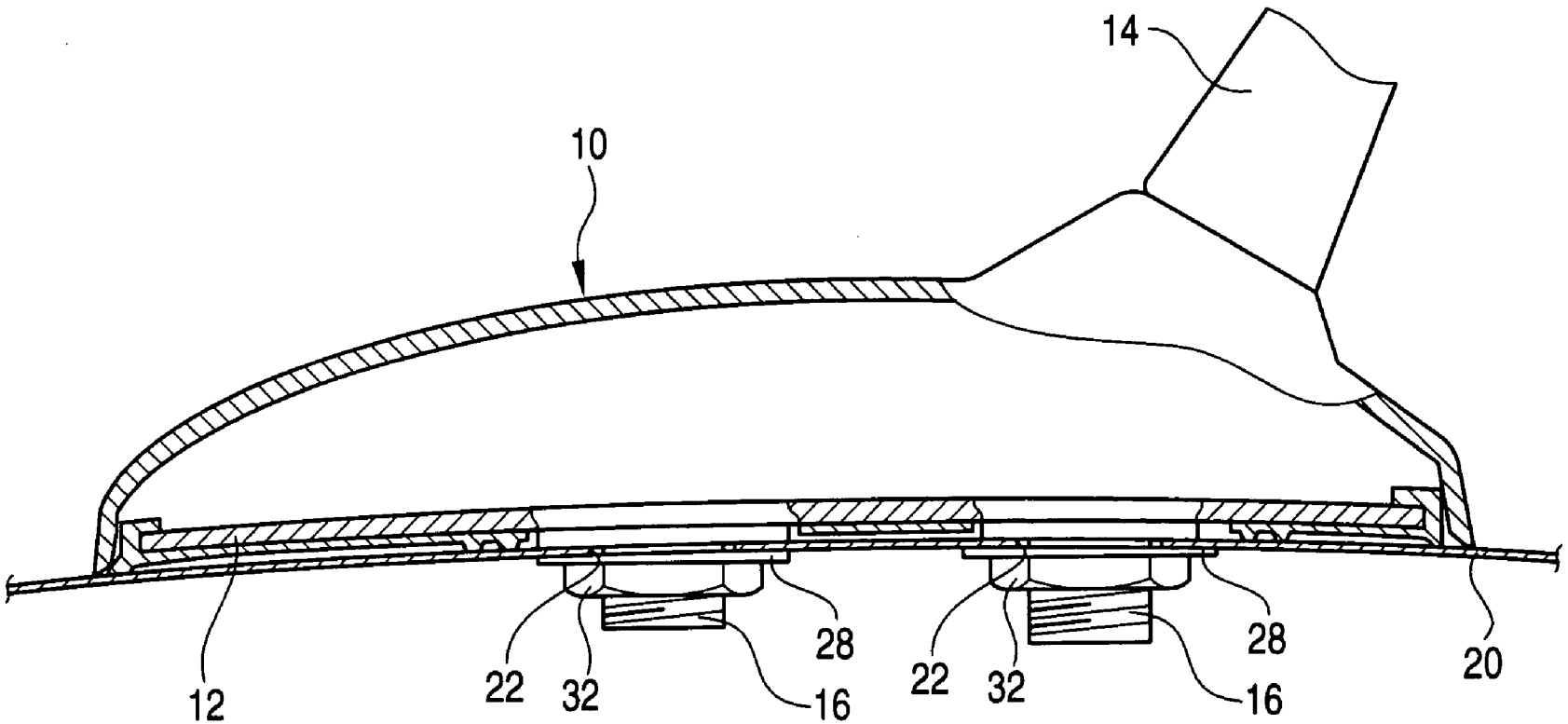
FIG. 13 is a side section view of a conventional mounting structure.

Next, an eighth embodiment of the invention will be described below with reference to FIGS. 12A and 12B. Similar components to those in the first embodiment will be designated by the same reference numerals, and repetitive explanations for those will be omitted.

In this embodiment, a retainer 44 composed of resin is arranged over the bulge 18*a* of the fixing screw 18, and the both ends thereof are fixed to the antenna base 12 by screws 46.

With the above configuration, the structure for preventing the fixing screw 18 from escaping upward can be remarkably simplified.

In the above embodiments, one or two swingable fixing screws 18 are provided in the antenna base 12. However, three or more fixing screws may be provided in an antenna base 12 having a relatively large base area, while at least one or more of them may be configured to be swingable.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna adapted to be mounted on a vehicle body, comprising:

an antenna base, formed with a first through hole;

a first fixing screw, comprising a first thread portion adapted to be inserted into a second through hole formed in the vehicle body via the first through hole, and a first head portion continued from the first thread portion;

a receptacle, provided on the antenna base and receiving the first head portion such that an axis of the first fixing screw is swingable relative to the antenna base; and a first nut, adapted to be fitted with the first thread portion so as to clamp the vehicle body together with the first head portion, wherein the largest dimension across the first head portion in a radial direction is larger than the largest dimension of the second through hole in radial direction.

2. The antenna as set forth in claim 1, further comprising an elastic pad disposed between the antenna base and the vehicle body.

3. The antenna as set forth in claim 1, wherein a size of the first through hole is smaller than the size of the first head portion so that the receptacle has a receiving face brought into contact with a lower face of the first head portion.

4. The antenna as set forth in claim 3, wherein at least one of the receiving face and the lower face of the first head portion is rounded.

5. The antenna as set forth in claim 1, further comprising an elastic spacer disposed between the receptacle and the first head portion.

6. The antenna as set forth in claim 1, wherein a direction that the first fixing screw is swingable is so restricted as to be a longitudinal direction of the antenna base.

7. The antenna as set forth in claim 6, wherein the first head portion is provided with a shaft member extending in a direction perpendicular to the longitudinal direction of the antenna base, and the receptacle is formed with a groove receiving the shaft member.

8. The antenna as set forth in claim 6, wherein a protrusion is formed on the antenna base so as to extend in a direction perpendicular to the longitudinal direction of the antenna base, and the first head portion is formed with a groove receiving the protrusion.

9. The antenna as set forth in claim 1, further comprising a retainer provided on the antenna base so as to hang over the first head portion to prevent the first fixing screw from escaping in a direction being away from the vehicle body.

10. An antenna adapted to be mounted on a vehicle body, comprising:

an antenna base, formed with a first through hole;

a first fixing screw, comprising a first thread portion adapted to be inserted into a second through hole formed in the vehicle body via the first through hole, and a first head portion continued from the first thread portion and having a size larger than the second through hole;

a receptacle, provided on the antenna base and receiving the first head portion such that an axis of the first fixing screw is swingable relative to the antenna base;

a first nut, adapted to be fitted with the first thread portion so as to clamp the vehicle body together with the first head portion;

a second fixing screw integrally provided on the antenna base, the second fixing screw comprising a second thread portion adapted to be inserted into a third through hole formed in the vehicle body, and a second head portion continued from the second thread portion and having a size larger than the third through hole; and a second nut, adapted to be fitted with the second thread portion so as to clamp the vehicle body together with the second head portion.

11. The antenna as set forth in claim 10, further comprising an elastic pad disposed between the antenna base and the vehicle body.

12. The antenna as set forth in claim 10, wherein a size of the first through hole is smaller than the size of the first head portion so that the receptacle has a receiving face brought into contact with a lower face of the first head portion.

13. The antenna as set forth in claim 12, wherein at least one of the receiving face and the lower face of the first head portion is rounded.

14. The antenna as set forth in claim 10, further comprising an elastic spacer disposed between the receptacle and the first head portion.

15. The antenna as set forth in claim 10, wherein a direction that the first fixing screw is swingable is so restricted as to be a longitudinal direction of the antenna base.

16. The antenna as set forth in claim 15, wherein the first head portion is provided with a shaft member extending in a direction perpendicular to the longitudinal direction of the antenna base, and the receptacle is formed with a groove receiving the shaft member.

17. The antenna as set forth in claim 15, wherein a protrusion is formed on the antenna base so as to extend in a direction perpendicular to the longitudinal direction of the antenna base, and the first head portion is formed with a groove receiving the protrusion.

18. The antenna as set forth in claim 10, further comprising a retainer provided on the antenna base so as to hang over the first head portion to prevent the first fixing screw from escaping in a direction being away from the vehicle body.

* * * * *